US005161985A

United States Patent [19]

Ramsey

[11] Patent Number: 5,161,985

[45] Date of Patent: Nov. 10, 1992

[54] BOARD TO BOARD INTERCONNECT

[75] Inventor: James M. Ramsey, Clarksville, Ind.

[73] Assignee: Robinson Nugent, Inc., New Albany, Ind.

[21] Appl. No.: 742,849

[22] Filed: Aug. 8, 1991

[51] Int. Cl.[5] ..... H01R 9/09

[52] U.S. Cl. ..... 439/74; 439/76; 439/81; 439/284

[58] Field of Search ..... 439/74-76, 439/81, 83, 284, 289-291, 295

[56] References Cited

U.S. PATENT DOCUMENTS

| | | | |
|---|---|---|---|
| Re. 32,760 | 10/1988 | Chandler et al. | 439/295 |
| 3,638,164 | 1/1972 | Glance et al. | 439/284 |
| 3,688,243 | 8/1972 | Yamada et al. | 439/295 |
| 3,732,525 | 5/1973 | Henschen et al. | 339/49 R |
| 3,858,957 | 1/1975 | Harwood et al. | 339/17 L |
| 4,482,937 | 11/1984 | Berg | 439/74 |
| 4,734,052 | 3/1988 | Vandame | 439/293 |
| 4,753,613 | 6/1988 | Morgan | 439/291 |
| 4,904,212 | 2/1990 | Durbin et al. | 439/82 |

OTHER PUBLICATIONS

Samtec, Inc., "Full Line Catalog 1986", 1985, pp. 1-71.
Samtec, Inc., "Board-to-Board Interconnects", Interconnect Solutions Series S-186-2, 1986.
Burndy Corp., "Surface-Mounted 0.25 Pin Header", pp. 10-8 and 10-9, date unknown.
Burndy Corp., "Surface-Mounted Vertical Receptacle", pp. 10-11 and 10-12, date unknown.
McKenzie Technology, "High Profile Elevated SIP Sockets", p. C3, date unknown.
McKenzie Technology, "0.025" Square Post Extended Headers", p. 12, date unkown.
Advanced Interconnections, "Board to Board Interconnections", pp. 24-25, date unknown.

*Primary Examiner*—Paula A. Bradley
*Attorney, Agent, or Firm*—Barnes & Thornburg

[57] ABSTRACT

According to the present invention, an electrical connector includes a body having first and second portions. The connector also includes a plurality of first contacts situated in the first portion of the body. Each of said first contacts includes a first end portion configured to be coupled to a conductive member on a printed circuit board and a second free end portion situated within the first portion of the body to define a movable spring contact surface section. The connector further includes a plurality of second contacts situated in the second portion of the body. Each of said second contacts includes a first end portion configured to be coupled to a conductive member on the printed circuit board and a second end portion coupled to the second portion of the body to define a fixed contact surface section. The connector is configured to mate with an identically shaped second connector coupled to a second printed circuit board so that the plurality of movable spring contact surface sections of the first connector engage a plurality of fixed contact surface sections of the second connector and the plurality of fixed contact surface sections of the first connector engage a plurality of movable spring contact surface sections of the second connector to couple the first printed circuit board to the second printed circuit board.

18 Claims, 2 Drawing Sheets

BOARD TO BOARD INTERCONNECT

BACKGROUND AND SUMMARY OF THE INVENTION

The present invention relates to electronic connectors for coupling first and second printed circuit boards together. More particularly, the present invention relates to a board to board interconnect which reduces the required stack height between two adjacent printed circuit boards which are coupled together and which reduces the amount of board space used by the interconnect.

Typical board to board interconnects have both male and female connector portions which mate together to form an electrical connection between the two circuit boards. Male connector pins are coupled to a first circuit board. The male connector pins mate with female connectors coupled to a second circuit board. This type of board to board interconnect requires that two types of connectors be inventoried in order to couple two printed circuit boards together.

The present invention is a hermaphroditic connector design. In other words, the connector made according to the present invention can be mated to another connector having an identical shape in only a single orientation to ensure proper electrical connection between two adjacent printed circuit boards. Therefore, only one type of connector needs to be inventoried.

Conventional hermaphroditic connectors use two movable spring contacts to provide an electrical connection between adjacent printed circuit boards (PCBs). When two of these conventional connectors are mated, the spring forces on the movable spring contacts are dependent on the PCB to PCB stack height and tolerance. As the distance between the two connectors decreases, the contact normal force or spring force against the mating contacts increases. Therefore, by having two moving spring contacts, the PCB to PCB stack height tolerance range must be decreased for conventional connectors to adequately control the range of normal force.

According to the present invention, an electrical connector includes a body having first and second portions. The connector includes a plurality of first contacts situated in the first portion of the body. Each of said first contacts includes a first end portion configured to be coupled to a conductive member on a first printed circuit board and a second free end portion situated within the first portion of the body to define a movable spring contact surface section. The connector further includes a plurality of second contacts situated in the second portion of the body. Each of said second contacts includes a first end portion configured to be coupled to a conductive member on the first printed circuit board and a second end portion coupled to the second portion of the body to define a fixed contact surface section. The connector is configured to mate with an identically shaped second connector coupled to a second printed circuit board so that the plurality of movable spring contact surface sections of the first connector engage a plurality of fixed contact surface sections of the second connector and the plurality of fixed contact surface sections of the first connector engage a plurality of movable spring contact surface sections of the second connector to couple the first printed circuit board to the second printed circuit board.

One feature of the present invention is the provision of a series of fixed contacts and a series of spring contacts in each connector. In use, a first connector is coupled to a first PCB and a second connector is coupled to a second PCB. When the two connectors are mated, the spring contacts of the first connector mate with the fixed contacts of the second connector and the spring contacts of the second connector mate with the fixed contacts with the first connector. This reduces the required overall PCB to PCB stack height (distance between two coupled circuit boards) because only one spring height is required. Because the present invention uses both spring contacts and fixed contacts, the spring force on the movable contacts is the same from its initial mate height until the final mate height. This permits a wide tolerance range for the PCB to PCB stack height. The movable spring contacts are deflected by the same predetermined amount regardless of the PCB to PCB stack height. This advantageously reduces the likelihood of damaging the movable spring contacts.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
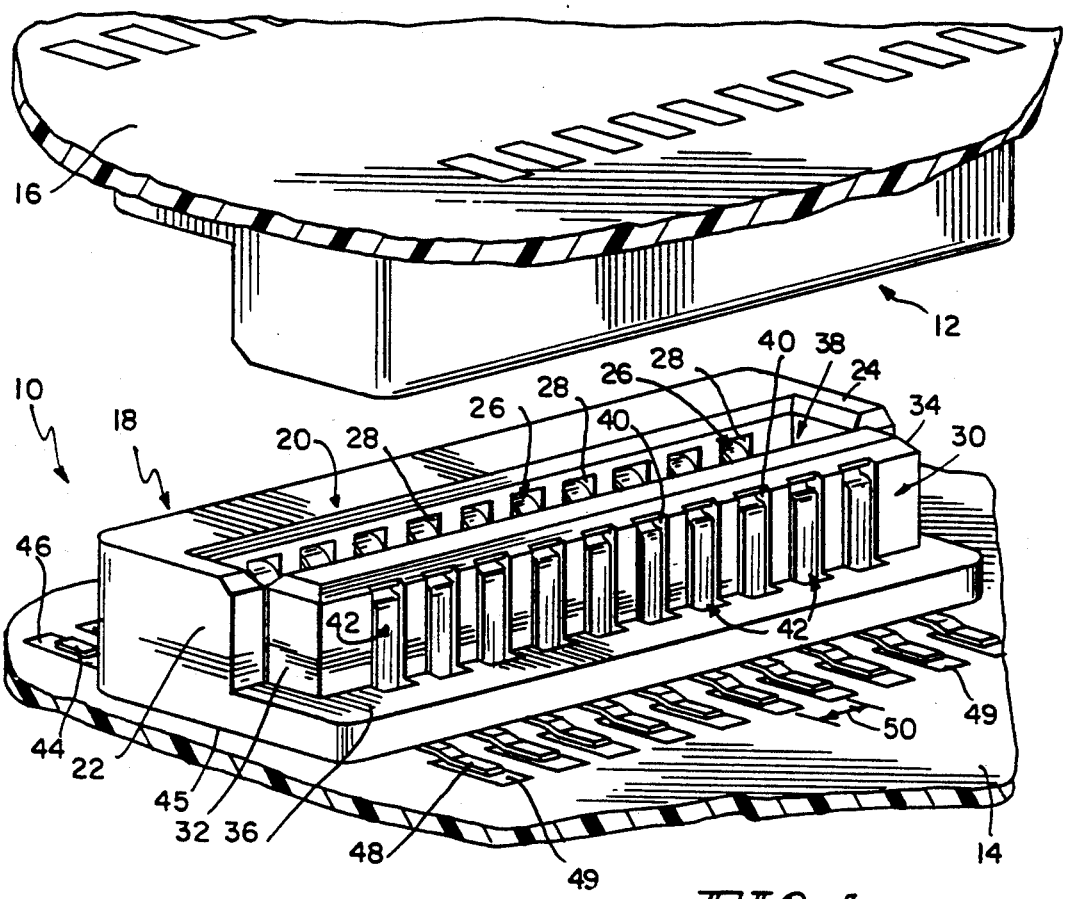
FIG. 1 is a perspective view illustrating two identically shaped connectors coupled to adjacent printed circuit boards to form a board to board interconnect according to the present invention.

Referring now to the drawings, FIG. 1 illustrates a pair of identical connectors 10 and 12 for coupling a first printed circuit board (PCB) 14 to a second PCB 16. The connectors 10 and 12 are identical. Therefore, only the configuration of connector 10 Will be discussed in detail. Elements in connector 12 which are identical to the elements of connector 10 are numbered in the 100's with the same last two digits as the elements in connector 10. Connector 10 includes a molded plastic body portion 18 having a first section 20 including end walls 22 and 24 for housing a series of spring contacts 26 therein. The first portion 20 of body 18 is formed to include a plurality of openings 28 which permit spring contacts 26 to project outwardly from the first portion 20 of body 18 to lie within cavity 38.

Body 18 also includes a second portion 30 including first and second ends 32 and 34 extending upwardly away from base surface 36 of body 18. The second portion 30 of body 18 is spaced apart from the first portion 20 of body 18 to define an opening or cavity 38 therebetween. Second portion 30 of body 18 includes a plurality of openings 40 which expose a series of fixed contacts 42.

Spring contacts 26 include first end portions or solder tails 44 which project outwardly from bottom surface 45 of body 18. Solder tails 44 are configured to be coupled to conductive surfaces 46 on PCB 14. Fixed contacts 42 also include first end portions or solder tails 48 which project outwardly from bottom surface 45 in a direction opposite solder tails 44. Solder tails 48 are configured to be coupled to conductive surfaces 49 on PCB 14.

Each adjacent spring contact 26 and fixed contact 42 are spaced apart by a predetermined distance illustrated by dimension 50 in FIG. 1. Illustratively, the dimension 50 is about 1 mm. This spacing allows for about a 50% reduction in the amount of space on PCB 14 and PCB 16 covered by connectors 10 and to interconnect PCB 14 to PCB 16 compared to conventional connectors. Therefore, the present invention permits PCB 14 to be coupled to PCB 16 using substantially less board space than conventional board to board interconnects. Spring contacts 26 and fixed contacts 42 are preferably made from a BeCu or Phosphor Bronze material.

Figure 2:
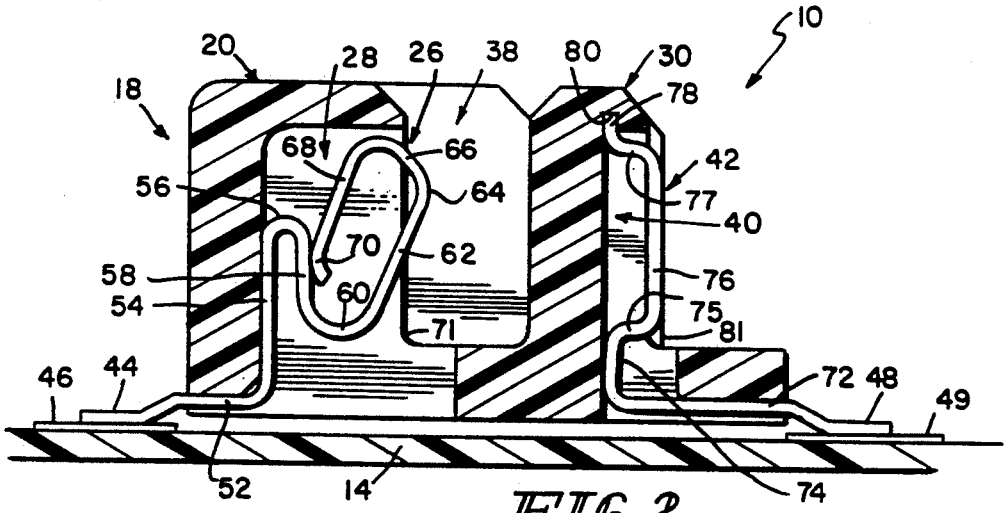
FIG. 2 is a sectional view taken through one of the connectors of FIG. 1 illustrating a first fixed contact and a second spring contact situated within the connector body.

The configuration of connector 10 is best illustrated in FIG. 2. As discussed above, connectors 10 and 12 have an identical configuration. In other words, the connectors 10 and 12 are hermaphroditic. Therefore, only the configuration of connector 10 will be discussed.

Figure 3:
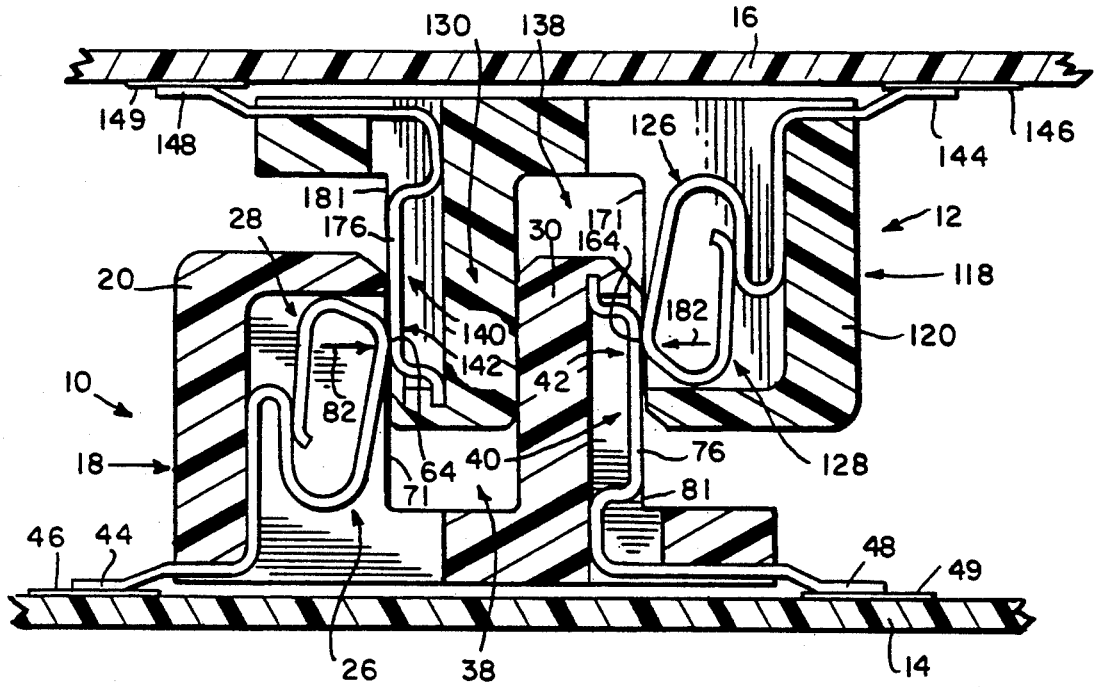
FIG. 3 illustrates the present invention when first and second connectors are initially coupled together to couple the first and second printed circuit boards together.
Figure 4:
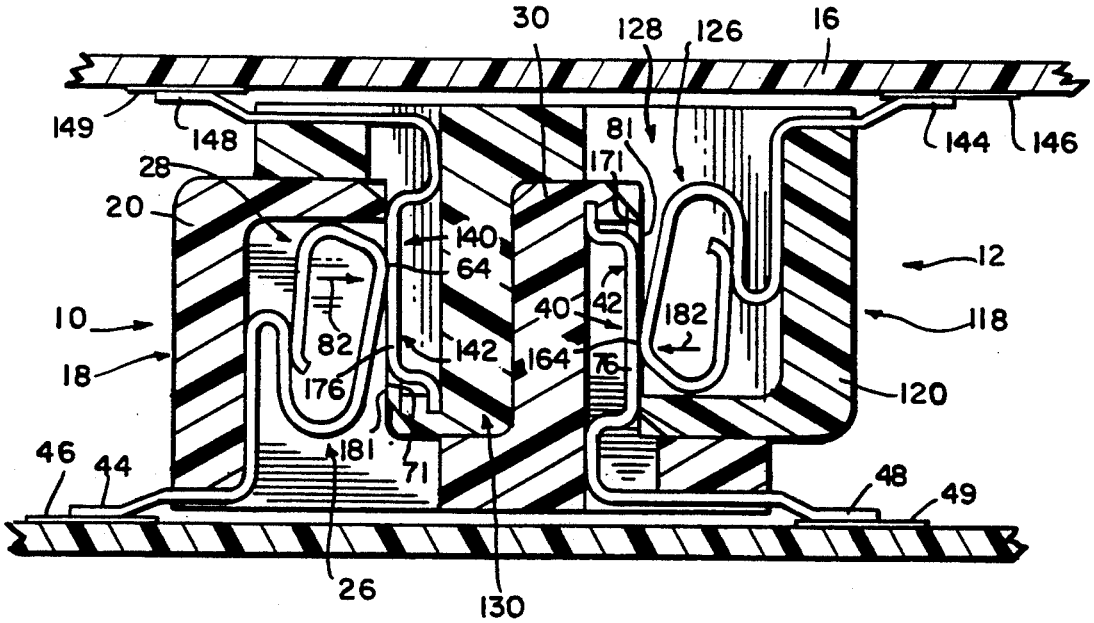
FIG. 4 illustrates the first and second connectors in their fully inserted position.

Spring contacts 26 are situated within openings 28 in first portion 20 of body 18. Spring contacts 26 include a first end portion 44 configured to be coupled to a conductive surface 46 on PCB 14. Spring contact 26 also includes a section 52 which is substantially parallel to solder tail 44 and a section 54 which is substantially perpendicular to section 52. A U-shaped section 56 is situated between section 54 and section 58 of spring contact 26. Spring contact 26 also includes a turn-back section 60 and an angled section 62 which ends at a spring contact section 64. Spring contact section 64 provides an electrical connection with a fixed contact 142 of connector 12 when two connectors 10 and 12 ar® coupled together as illustrated in FIGS. 3 and 4. Returning now to FIG. 2, spring contact 26 further includes a turn-back loop section 66 and an angled section 68. A second end 70 of spring contact 26 engages section 58 of spring contact 26. Spring contact section 64 of spring contact 26 extends outwardly from opening 28 of the first portion 20 of body 18 beyond side wall 71 so that the movable spring contact section 64 lies within the cavity 38. Side wall 71 of first portion 20 of body 18 cooperates with the second portion 30 of body 18 to define cavity 38 therebetween.

Fixed contacts 42 are situated within openings 40 formed in the second portion 30 of body 18. Fixed contact 42 includes a first end section 48 which provides a solder tail for coupling to a conductive surface 49 on PCB 14. Fixed contact 42 includes a straight section 72 generally parallel to solder tail 48. Section 74 is of fixed contact 42 generally perpendicular to straight section 72. Bent section 75 is situated between section 74 and the fixed contact surface section 76. Bent section 77 is situated between the fixed contact section 76 and the second end 78 of fixed contact 42. Second end 78 is rigidly coupled to the second portion 30 of body 18 within a recess 80 formed in second portion 30. Fixed contact support surface 76 is positioned to lie in substantially the same plane as the generally planar side wall 81 of second portion 30 of body 18.

FIG. 3 illustrates the connectors 10 and 12 after initial mating or engagement of the series of movable spring contact sections 64 of spring contacts 26 of connector 10 with the fixed contact surface sections 176 of fixed contacts 142 of connector 12 and upon initial mating or engagement of the movable spring contact sections 164 of spring contacts 126 of connector 12 with the fixed contact surface sections 76 of fixed contacts 42 connector 10. Spring contacts 26 and 126 apply a spring force illustrated by arrows 82 and 182, respectively, on fixed contact surface sections 176 and 76. The spring forces are sufficient to ensure a proper electrical connection between PCBs 14 and 16. By having a series of fixed contact sections 76 and 176 which mate with a series of spring contact sections 64 and 164, the overall PCB to PCB stack height can be reduced to 0.150 inch. In other words, only one functional spring contact spring is required to work in the 0.150 inch space. This permits a wide tolerance range for the PCB to PCB stack height. The movable spring contacts are deflected by the same predetermined mount regardless of the PCB to PCB stack height. Therefore, spring contacts 26 and 126 apply the same spring force to fixed contact surface sections 176 and 76 throughout the entire range from initial mating illustrated in FIG. 3 to the fully inserted position illustrated in FIG. 4.

FIG. 4 illustrates the connectors 10 and 12 in the fully inserted position to couple PCB 14 to PCB 16. The second portion 30 of body 18 of connector 10 is sized to enter cavity 138 of connector 12 so that the fixed contact surface 76 of connector 10 engages the spring contact section 164 of connector 12. The second portion 130 of connector 12 is sized to enter the cavity 38 of connector 10 so that fixed contact section 176 of connector 12 engages spring contact section 64 of connector 10. Therefore, PCB 14 and PCB 16 are electrically coupled together. When the connectors 10 and 12 are fully inserted as illustrated in FIG. 4, the connectors 10 and 12 permit a minimum PCB to PCB height of 0.150 inch. This permits unit designers to use connectors 10 and 12 to reduce the overall unit size.

In operation, solder tails 44 and 48 of connector 10 are coupled to conductive surfaces 46 and 49, respectively, On PCB 14 using Vapor face or IR reflow soldering processes. Solder tails 144 and 148 are coupled to conductive surfaces 146 and 149, respectively, of PCB 16 using the same soldering process. It is understood that other means of coupling connectors 10 and 12 to PCBs 14 and 16 may be used without deviating from the present invention.

Connectors 10 and 12 are then mated by sliding the second portions 30 and 130 of connectors 10 and 12 into the cavities 138 and 38, respectively, of connectors 12 and 10. Side wall 71 of first portion 20 of connector 10 abuts side wall 181 of second portion 130 of connector 12. Side wall 81 of second portion 30 of connector 10 abuts side wall 171 of first portion 120 of connector 12. Fixed contact surface sections 76 and 176 deflect the movable spring contacts 126 and 26, respectively, into openings 128 and 28. Therefore, movable spring contacts 26 and 126 apply a spring force in the directions of arrows 82 and 182 to force spring contact surfaces 64 and 164 against fixed contact surfaces 176 and 76, respectively. First and second connectors 10 and 12 can be used to couple PCBs 14 and 16 together at any position between the initial mating position illustrated in FIG. 3 and the fully inserted position illustrated in FIG. 4.

Although the invention has been described in detail with reference to a certain preferred embodiment, variations and modifications exist within the scope and spirit of the invention as described and defined in the following claims.

What is claimed:

1. An electrical connector comprising a body including first and second portions, the first portion of said body having a generally planar side wall formed to include a plurality of openings therein defining a plurality of first chambers, the second portion of said body having a generally planar side wall formed to include a plurality of openings therein defining a plurality of second chambers, the generally planar side wall of the first portion of the body cooperating with the second portion of the body to define a cavity therebetween;

a plurality of first contacts situated in the plurality of first chambers formed in the first portion of the body, each of said first contacts including a first end portion configured to be coupled to a conductive member on a first printed circuit board and including a second free end portion situated within the first portion of the body to define a movable spring contact surface section, the first contacts being configured so that the movable spring contact surface sections extend beyond the plane of said side wall of the first body portion to project into said cavity; and a plurality of second contacts situated in the plurality of second chambers formed int he second portion of the body, each of said second contacts including a first end portion configured to be coupled to a conductive member on the first printed circuit board and including a second end portion coupled to the second portion of the body to define a fixed contact surface section, the second contacts being configured so that the fixed contact surface sections lie substantially in the same plane as said generally planar side wall of the second portion of the body, the connector being configured to mate with an identically shaped second connector coupled to a second printed circuit board so that the plurality of movable spring contact surface sections of the first connector engage a plurality of fixed contact surface sections of the second connector and the plurality of fixed contact surface sections of the first connector engage a plurality of movable spring contact surface sections of the second connector to couple the first printed circuit board to the second printed circuit board.

2. The connector of claim 1, wherein the each of the plurality of first contacts is spaced apart from an adjacent first contact by about 1 mm.

3. The connector of claim 1, wherein the each of the plurality of second contacts is spaced apart from an adjacent second contact by about 1 mm.

4. The connector of claim 1, wherein the cavity is adapted to receive a second portion of a body of said second connector therein so that a side wall of the second portion of the second connector abuts the side wall of the first portion of the first connector and the plurality of movable spring contact surface sections of the first connector engage the plurality of fixed contact surface sections of the second connector to couple the first and second printed circuit boards together.

5. The connector of claim 4, wherein the the second portion of the body of said first connector is configured to enter a cavity formed between first and second portions of the second connector so that a side wall of the first portion of the second connector abuts the side wall of the second portion of the first connector and the plurality of movable spring contact surface sections of the second connector engage the plurality of fixed contact surface sections of the first connector to couple the first and second printed circuit boards together.

6. The connector of claim 1, wherein the first contacts each include a generally U-shaped loop section between the first and second ends.

7. The connector of claim 6, wherein the generally U-shaped loop section includes first and second leg sections and the second free end of each of the first contacts is coupled to the second leg section.

8. A hermaphroditic electrical connector which is configured to mate with an identically shaped second connector to couple a first printed circuit board to a second printed circuit board, each connector comprising a body including first and second portions, the first portion of said body having a generally planar side wall formed to include a plurality of openings therein defining a plurality of first chambers, the second portion of said body having a generally planar side wall formed to include a plurality of openings therein defining a plurality of second chambers, the generally planar side wall of the first portion of the body cooperating with the second portion of the body to define a cavity therebetween;

first contact means situated in the first portion of the body, the first contact means including means for providing a movable spring contact in the first chambers of the first portion of the body and means for coupling the first contact means to a conductive member on its associated printed circuit board, the first contact means being configured so that the movable spring contacts extend beyond the plane of said side wall of the first body portion to project into said cavity; and second contact means situated in the second portion of the body, the second contact means including means for providing a fixed contact in the second chambers of the second portion of the body and means for coupling the second contact means to a conductive member on said associated printed circuit board, the second contact means being configured so that the fixed contacts lie substantially in the same plane as said generally planar side wall of the second portion of the body, wherein the movable spring contact surface section of the first connector is configured to engage a fixed contact surface section of the second connector and the fixed contact surface section of the first connector is configured to engage a movable spring contact surface section of the second connector to couple the first printed circuit board to the second printed circuit board.

9. The connector of claim 8, wherein the cavity is adapted to receive a second portion of a body of said second connector therein so that a side wall of the second portion of the second connector abuts the side wall of the first portion of the first connector and movable spring contacts of the first connector engage the fixed contacts of the second connector to couple the first and second printed circuit boards together.

10. The connector of claim 9, wherein the the second portion of the body of said first connector is configured to enter a cavity formed between first and second portions of the second connector so that a side wall of the first portion of the second connector abuts the side wall of the second portion of the first connector and movable spring contacts of the second connector engage the fixed contacts of the first connector to couple the first and second printed circuit boards together.

11. The connector of claim 8, wherein the first contact means include a generally U-shaped loop section between first and second ends.

12. The connector of claim 11, wherein the generally U-shaped loop section includes first and second leg sections and a second free end of the first contact means is coupled to the second leg section.

13. An electrical connector comprising an insulative body including a base, a first portion extending upwardly from the base, and a second portion extending upwardly away from the base spaced apart from the first portion to define a cavity therebetween, the first portion of the body including a generally planar side wall formed to include a plurality of openings therein defining a plurality of chambers, and the second portion of the body including a generally planar side wall formed to include a plurality of openings therein defining a plurality of chambers, the generally planar side wall of the first portion of the body cooperating with the second portion of the body to define the cavity therebetween;

a plurality of first contacts situated in the plurality of chambers formed in the first upwardly extending portion of the body, each of said first contacts including a first end portion configured to be coupled to a conductive member on a first printed circuit board and including a second free end portion situated within the first portion of the body to define a movable spring contact surface section, the first contacts being configured so that the movable spring contact surface sections extend beyond the plane of said side wall of the first body portion to project into said cavity; and a plurality of second contacts situated in the plurality of chambers formed in the second upwardly extending portion of the body, each of said second contacts including a first end portion configured to be coupled to a conductive member on the first printed circuit board and including a second end portion coupled to the second portion of the body to define a fixed contact surface section, the second contacts being configured so that the fixed contact surface sections lie substantially in the same plane as said generally planar side wall of the second portion of the body, the connector being configured to mate with an identically shaped second connector coupled to a second printed circuit board so that the plurality of movable spring contact surface sections of the first connector engage a single side of a plurality of fixed contact surface sections of the second connector and a single side of the plurality of fixed contact surface sections of the first connector engage a plurality of movable spring contact surface sections of the second connector to couple the first printed circuit board to the second printed circuit board.

14. The connector of claim 13, wherein the each of the plurality of first contacts is spaced apart from an adjacent first contact by about 1 mm.

15. The connector of claim 13, wherein the each of the plurality of second contacts is spaced apart from an adjacent second contact by about 1 mm.

16. The connector of claim 13, wherein the first contacts each include a generally U-shaped loop section between the first and second end portions.

17. The connector of claim 13, wherein the cavity is adapted to receive a second portion of a body of said second connector therein so that a side wall of the second portion of the second connector abuts the side wall of the first portion of the first connector and the plurality of movable spring contact surface sections of the first connector engage the plurality of fixed contact surface sections of the second connector to couple the first and second printed circuit boards together.

18. The connector of claim 17, wherein the second portion of the body of said first connector is configured to enter a cavity formed between first and second portions of the second connector so that a side wall of the first portion of the second connector abuts the side wall of the second portion of the first connector and the plurality of movable spring contact surface sections of the second connector engage the plurality of fixed contact surface sections of the first connector to couple the first and second printed circuit boards together.

* * * * *